US006234465B1

(12) United States Patent
Sutton, Jr.

(10) Patent No.: US 6,234,465 B1
(45) Date of Patent: May 22, 2001

(54) CLAMPING APPARATUS

(76) Inventor: Elias A. Sutton, Jr., 8221 River Corners Rd., Homerville, OH (US) 44235

( * ) Notice: Subject to any disclaimer, the term of this patent is extended or adjusted under 35 U.S.C. 154(b) by 0 days.

(21) Appl. No.: 09/523,608

(22) Filed: Mar. 13, 2000

(51) Int. Cl.[7] ..... B25B 1/08
(52) U.S. Cl. ..... 269/234; 72/422; 24/248
(58) Field of Search ..... 269/234, 229, 269/238; 24/134 N, 134 P, 248 E, 263, 137 A, 251, 136 R; 294/116, 86.29, 136, 86.3, 86.31; 254/22, 29

(56) References Cited

U.S. PATENT DOCUMENTS

| | | | | |
|---|---|---|---|---|
| 1,837,425 | | 12/1931 | Gastan . | |
| 2,893,275 | | 7/1959 | Lindermann . | |
| 3,879,814 | * | 4/1975 | Mojeski | 24/248 |
| 3,988,865 | | 11/1976 | Weisman . | |
| 4,324,125 | * | 4/1982 | Jarman et al. | 72/479 |
| 4,457,159 | * | 7/1984 | Jarman et al. | 72/290 |
| 4,513,474 | | 4/1985 | Watabe . | |
| 4,515,355 | * | 5/1985 | Hunter | 83/277 |
| 4,834,356 | | 5/1989 | Fox . | |
| 4,844,210 | * | 7/1989 | Wong | 188/65.1 |
| 5,156,240 | * | 10/1992 | Ostrobrod | 188/65.1 |
| 5,483,997 | * | 1/1996 | Corain | 139/194 |

* cited by examiner

*Primary Examiner*—Joseph J. Hail, III
*Assistant Examiner*—Daniel Shanley
(74) *Attorney, Agent, or Firm*—Christopher L. Parmele

(57) ABSTRACT

An apparatus for clamping metal concrete forms. The clamping apparatus includes a clamp body (10) and wedge (20). The clamp body includes two opposed sides (16) and (18) that define a tapered slot for receiving the wedge therebetween. The clamp body also includes an opening or mouth (12) that is operative to receive one or more work pieces which may be clamped together with the apparatus. The wedge is operative to move between a first position and a second position with respect to the clamp body. As the wedge slides between the first and second position within the slot, a front upper surface (22) of the wedge is operative to urge the work pieces against a jaw surface (15) of the clamp body that bounds the upper portion of the mouth. Also as the wedge slides toward the second position, the upper side wall portions (34) and (36) of the wedge slide adjacent a narrower portion of the slot (28). The compression and friction forces of the side walls of the clamp body and the upper side wall portions of the wedge act to hold the wedge in a locked position for maintaining a tight hold on the work pieces.

23 Claims, 5 Drawing Sheets

CLAMPING APPARATUS

TECHNICAL FIELD

This invention relates to a clamping apparatus. Specifically this invention relates to a new apparatus for quickly clamping and unclamping metal concrete forms.

BACKGROUND ART

Methods for clamping articles together are known in the prior art. FIG. 7 shows an example of a prior art C-clamp 100. Such a prior art C-clamp is operative to hold two or more work pieces together by tightening a threaded member 102. In the concrete construction industry a variety of such prior art C-clamps are used to secure metal form components together. The high labor costs associated with the construction trade requires that such forms be put together as quickly as possible. Unfortunately prior art C-clamps consume a considerable amount of time to properly clamp two or more metal plates together. Typically the construction worker must hold the C-clamp in position and turn the threaded member 102 with a wrench. Such an operation can be quite tedious, especially under cold weather conditions when gloves are worn.

In addition common contaminants on a construction site such as dirt, water, and concrete often become lodged within the threads of the clamp, making the process of tightening or un-tightening the clamp even more difficult and time consuming. In addition the threads and screws of the C-clamp tend to become corroded over time which also makes the clamp more difficult to install and remove. As a result prior art C-clamps must be frequently cleaned and/or replaced, which adds additional costs to the construction project.

Thus there exists a need for a clamping device for use with constructing metal concrete forms that is faster to install and remove. There is a further need for a clamping device that does not require a properly sized wrench to install and remove the clamp. In addition there is a further need for a clamping device that is not hindered by contamination and corrosion.

DISCLOSURE OF INVENTION

It is an object of the present invention to provide a clamping apparatus.

It is a further object of the present invention to provide a clamping apparatus that is operative to clamp metal plates together.

It is a further object of the present invention to provide a clamping apparatus that can be quickly installed and removed.

It is a further object of the present invention to provide a clamping apparatus that is easier to install and remove when wearing gloves.

It is a further object of the present invention to provide a clamping apparatus that can be installed and removed with a hammer.

It is a further object of the present invention to provide a clamping apparatus that is not hindered by corrosion and the buildup of contamination.

Further objects of the present invention will be made apparent in the following Best Modes for Carrying Out Invention and the appended claims.

The foregoing objects are accomplished in one exemplary embodiment of the invention by a "C" shaped clamp that includes a slidable and angled wedge. The clamp body includes an angled mouth for accepting work pieces for clamping. The clamp body further includes a slot between two opposed sides of the clamp body for receiving the angled wedge. When the wedge is slid forward within the slot, a front upper surface of the wedge moves forward within the mouth of the clamp body and is operative to urge work pieces against a jaw surface of the front upper portion of the clamp body. The work pieces can be released by sliding the wedge in the opposite direction (rearward), which moves the front upper surface of the wedge away from the jaw surface of the clamp body.

The slot within the C-clamp body is tapered such that the top portions of the slot are narrower than the bottom portions of the slot. When the wedge is pushed forward the back upper portions of the wedge move into contact with the narrower upper portions of the slot. When a hammer is used to pound the wedge further into the slot, the resulting friction and compression forces of the sides of the clamp body acting on the sides of the wedge are operative to prevent the wedge from sliding. In this position the apparatus is operative to hold work pieces together between the jaw surface of the clamp body and the front upper surface of the wedge.

Such a design enables the quick clamping of work pieces such as steel plates by hammering the wedge forward with respect to the clamp body. The clamp may be loosened to remove the work pieces by hammering the front of the wedge so as to drive the wedge rearward and out of the narrower portions of the slot. Unlike prior art clamps, both contamination and corrosion are operative to increase the effectiveness of the clamp by increasing the friction and compression forces between the wedge and the clamp body.

BEST MODES FOR CARRYING OUT INVENTION

Figure 1:
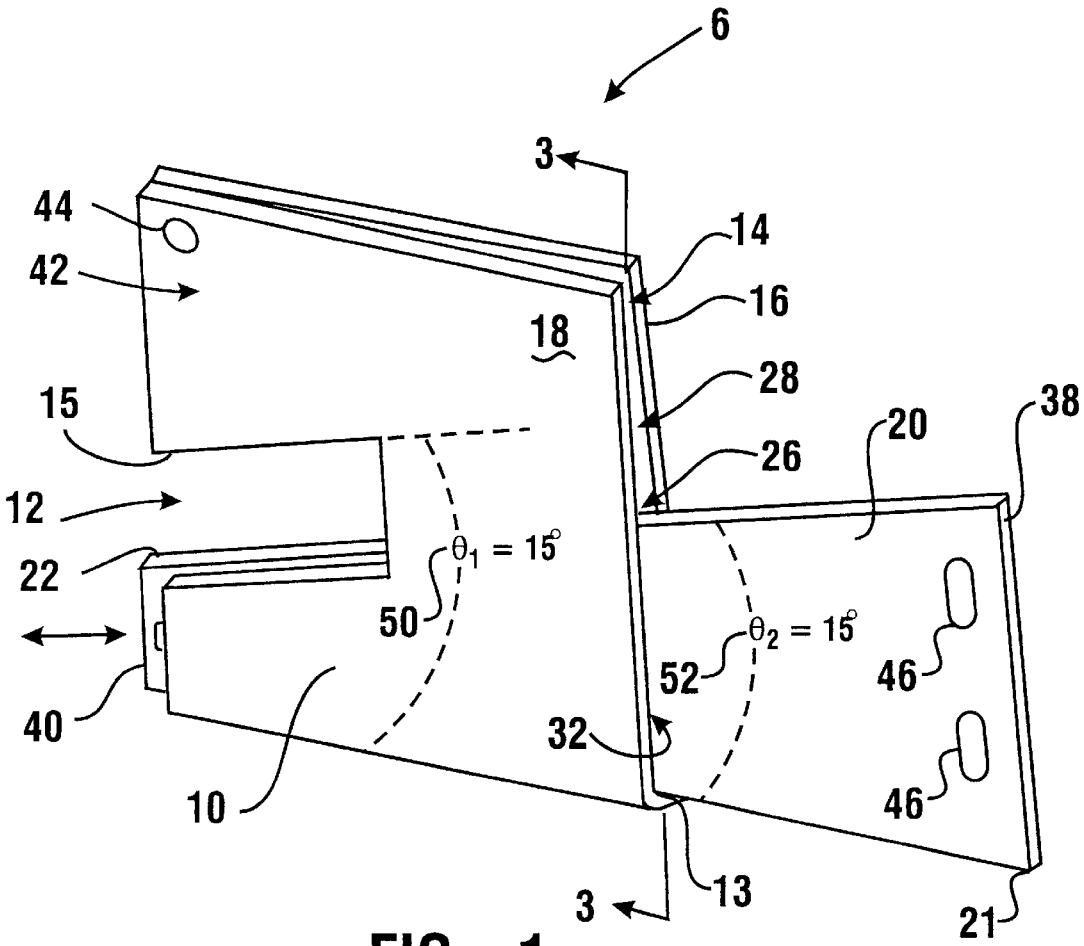
FIG. 1 is a perspective view representative of an exemplary embodiment of the clamping apparatus of the present invention with the wedge in a rearward position.

Referring now to the drawings and particularly to FIG. 1, there is shown therein a perspective view representative of an exemplary embodiment of the clamping apparatus 6. Here the clamp 6 comprises a "C" shaped clamp body 10. The clamp body 10 includes an opening or mouth 12. A front upper portion 42 of the clamp body includes a jaw surface 15 which bounds an upper portion of the mouth 12. When a workpiece is placed within the mouth 12, the jaw surface 15 is operative to receive the work piece adjacent thereto.

In addition the clamp body 10 includes a slot 14 between two opposed sides 16 and 18 of the clamp body. The slot 14 is operatively sized to receive a wedge 20. Wedge 20 is operative to slide within the slot 14 between a first or rearward position and a second or forward position with respect to the clamp body 10.

In the exemplary embodiment, the bottom edge 21 of the wedge is rounded. When the wedge moves between the rearward position and the forward position, portions of the bottom edge 21 of the wedge are operative to slide adjacent a lower surface of the slot 13. In the exemplary embodiment the lower surface of the slot 13 includes a curvature which corresponds to the rounded edge of the wedge 21. However, in alternative embodiments the bottom edge of the wedge 21 and the lower surface of the slot 13 may include other shapes including planar surfaces.

As shown in FIG. 1, the mouth 12 of the clamp body is angled with respect to the lower surface of the slot 13. In the exemplary embodiment, the angle 50 between the jaw surface 15 and the lower surface of the slot 13 is about fifteen degrees. However, alternative embodiments of the present invention may have a jaw surface with other angles, orientations, and curvatures based on the application and performance characteristics desired for the clamping apparatus. Other applications for example may include an angle between the jaw surface 15 and the lower slot surface 13 that ranges between five and forty-five degrees.

The wedge 20 includes a front upper surface 22 that is orientated to correspond to the angle 50 of the jaw surface 15. In the exemplary embodiment, an angle 52 between the front upper surface 22 of the wedge and the bottom edge 21 of the wedge is about fifteen degrees. However as with the angle of the jaw surface, alternative embodiments may have a front upper surface 22 of the wedge with other angles, orientations, and curvatures depending on the surface characteristics of the work pieces and the performance characteristics of the clamping apparatus.

Figure 2:
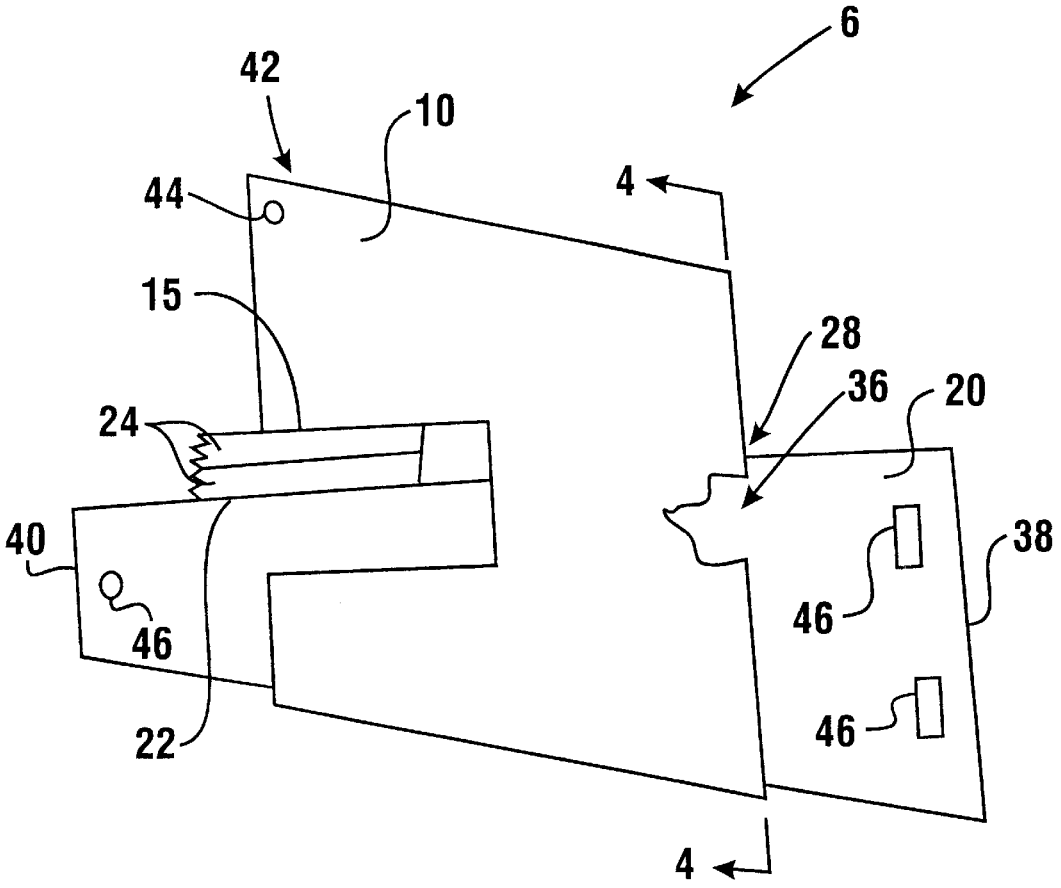
FIG. 2 is representative of a side view of the clamping apparatus with the wedge in the forward position.

As shown in FIG. 1, when the wedge 20 is slid toward a rearward position with respect to the clamp body 10, the space between the jaw surface 15 and the front upper surface 22 of the wedge becomes relatively wide. As shown in FIG. 2, when the wedge 20 is slid into a forward position with respect to the clamp body 10, the space between the jaw surface 15 and the front upper surface 22 of the wedge becomes more narrow. With this described configuration of clamp body 10 and wedge 20, one or more work pieces may be clamped and locked together between the jaw surface 15 and the front upper surface 22 of the wedge, by sliding the wedge 20 forward.

Figure 3:
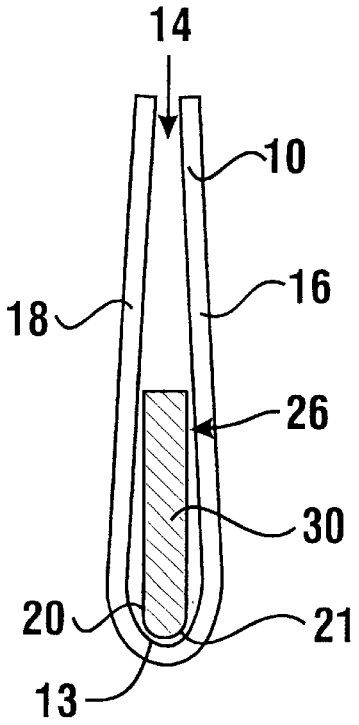
FIG. 3 is representative of a back cross-sectional view of the clamping apparatus with the wedge in the rearward position.
Figure 4:
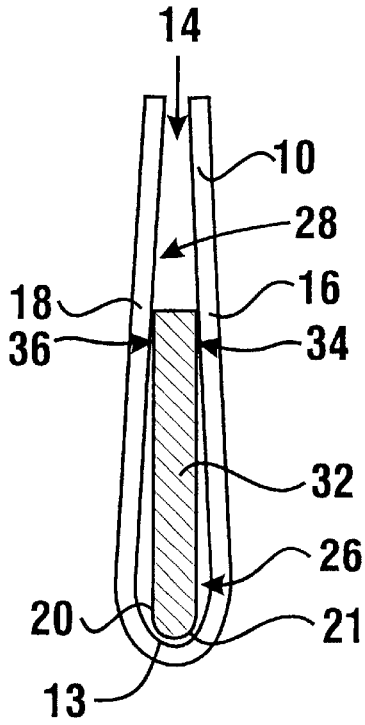
FIG. 4 is representative of a back cross-sectional view of the clamping apparatus with the wedge in the forward position.

To prevent the wedge from sliding backward and loosening the lock on the work pieces, the exemplary embodiment uses friction and compression forces within the slot 14 to hold the wedge 20 in the forward position. This is accomplished by tapering the slot 14. FIGS. 3 and 4 are representative of a back cross-sectional view of the slot 14 formed by the side walls 16 and 18 of the clamp body.

FIG. 3 generally corresponds to FIG. 1 with the wedge 20 located in the rearward position. The cross-section height of forward portions 30 of the wedge 20 located between the clamp sides 16 and 18 are relatively short. Thus the wedge 20 is operative to slide with less resistence within the wider portions 26 of the angled slot 14.

FIG. 4 generally corresponds to FIG. 2 with the wedge 20 located in a forward position. Here the cross-sectional height of the back portions 32 of the wedge located between the clamp sides 16 and 18 are relatively tall, resulting in the back upper side portions of the wedge 34 and 36 coming into contact with side walls 16 and 18 at the narrower upper portions 28 of the slot. The friction and compression forces between the wedge side walls 34 and 36 and the clamp side walls 16 and 18 are operative to hold the wedge in a locked position for clamping work pieces.

As shown in FIG. 2, the present exemplary embodiment is used to lock work pieces together by placing work pieces 24 in the mouth 12 between the jaw surface 15 and the front upper surface 22 of the wedge. A hammer may then be used to pound the back end portions 38 of the wedge such that the wedge 20 is driven forward with respect to the clamp body 10. As the wedge 20 is driven forward the back upper side portions of the wedge 34 and 36 become wedged between the side walls of the clamp body at the narrower upper portion 28 of the slot.

To unlock the work pieces 24 from the apparatus 6, a hammer is used to pound the front end portions 40 of the wedge such that the wedge is driven rearward with respect to the clamp body 10. In the rearward position as shown in FIG. 3, the friction and compression forces between the wedge 20 and the wider portions 26 of the slot are reduced.

In addition to the slot 14 being wider at the bottom portion 26 and being narrower at the top portion 28, the slot in the exemplary embodiment becomes increasingly narrower towards the front upper portion of the clamp body 42 where side walls 16 and 18 converge together. This narrowing of the slot towards the front upper portion of the clamp body 42 further increases the friction and compression forces acting between the wedge 20 and side walls 16 and 18 when the wedge 20 is driven further forward within the slot 14.

In the exemplary embodiment sides 16 and 18 are connected with a spot weld 44 at the front upper portion 42 of the clamp body. However, the present invention may encompasses other connection devices such as a bolt, rivet or any other device or process that is operative to hold sides 16 and 18 together when the wedge 20 is pounded toward the forward position.

In the exemplary embodiment the clamp and wedge are comprised of a low alloy steel, however, alternative embodiments of the present invention may be comprised of other materials including other steel alloys, aluminum, plastic, or any other material which has sufficient compression and friction characteristics to hold and lock the wedge 20 in place in a forward position with respect to the clamp body 10.

In addition the wedge and clamp body surfaces may include various coatings or have various surface finishes and contours which enhance the friction and locking characteristics of the apparatus. Also the apparatus may include additional locking features such the insertion of a pin into either the clamp body and/or wedge, which is operative to prevent the wedge from sliding rearward with respect to the clamp body.

As shown in FIGS. 1 and 2 the forward end 40 and the back end 38 of the wedge 20 include one or more raised portions 46 that are operative to prevent the wedge 20 from becoming detached from the clamp body 10. In addition subsequent hammering of the front and back ends of the wedge will lead to deformation and widening of the wedge ends. This deformation further prevents the wedge 20 from sliding out of the clamp body 10.

Figure 5:
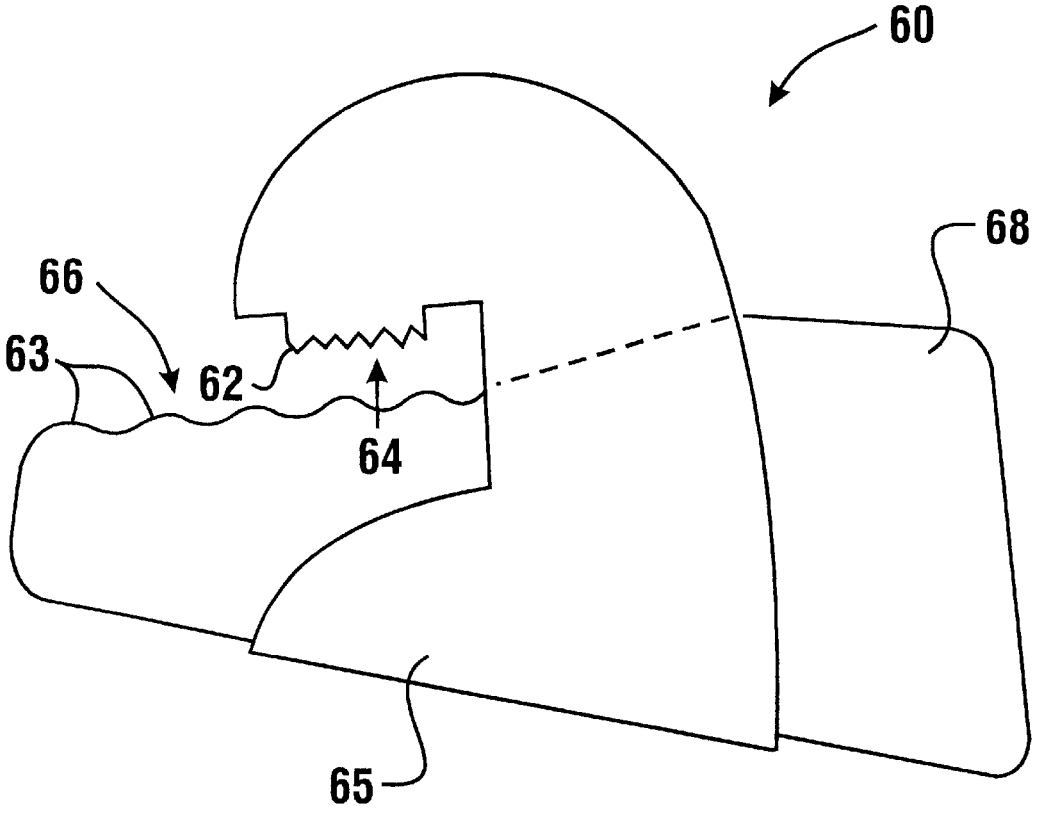
FIGS. 5 and 6 are representative of alternative exemplary embodiments of the clamping apparatus.

Although the described exemplary embodiment is shown with a jaw surface 15 and a front upper surface 22 of the wedge that are relatively planer, alternative embodiments may include other shapes and curvatures which are operative to hold one or more work pieces in a locked position within the mouth 12. For example the jaw surface 15 and the front upper surface 22 of the wedge may be inwardly curved for clamping around one or more work pieces. In addition the jaw surface 15 and the front upper surface 22 of the wedge may include teeth or other surface features and/or projections for preventing work pieces from slipping out of the grasp of the clamping apparatus. FIG. 5 shows an alternative exemplary embodiment 60 of the present invention with teeth 62 on the jaw surface 64 of the clamp body 65 and teeth 63 on the front upper surface 66 of the wedge 68.

Figure 6:
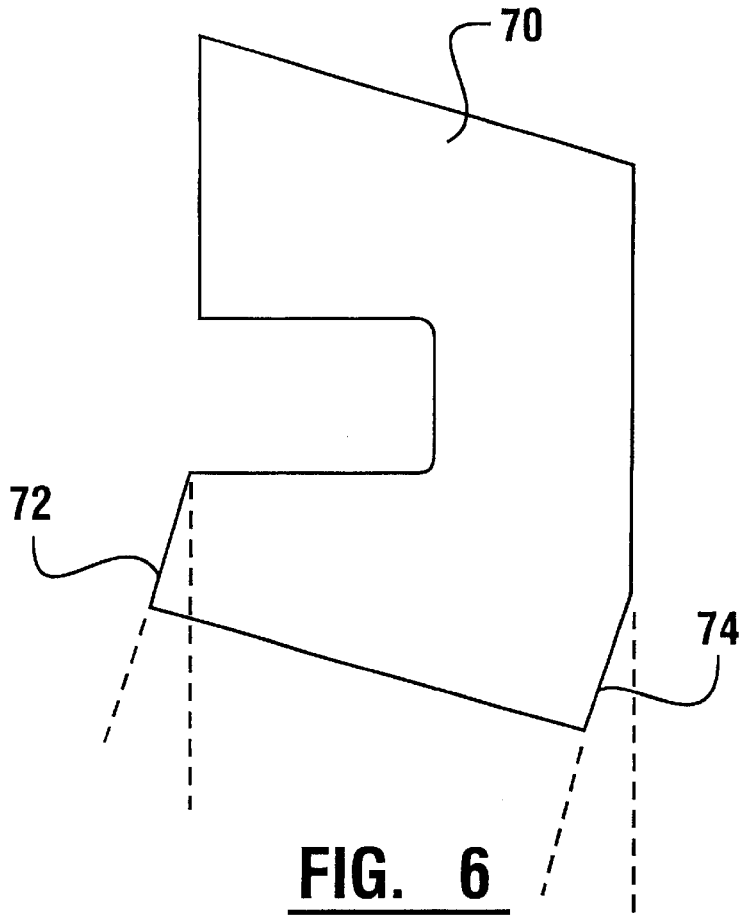
Figure 7:
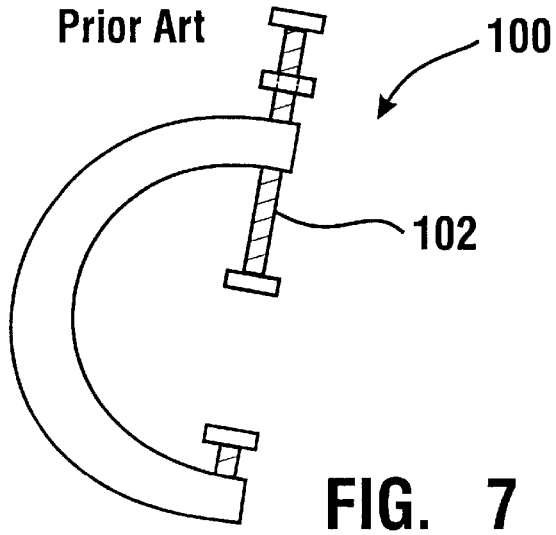
FIG. 7 is representative of a prior art C-clamp.

Another alternative exemplary embodiment is shown in FIG. 6. Here the clamp body 70 includes a lower front edge 72 and lower back edge 74 that are angled forward in parallel. These features enable the clamp body 70 to be fabricated at a lower cost by reducing the amount of material that is wasted in generating the clamp body 70. In the exemplary embodiment the clamp body is cut from a metal sheet and is folded to form a slot for receiving the wedge. Alternative embodiments may employ other fabrication techniques including injection molding.

Although the exemplary embodiments have been shown with a slot 14 that is tapered such that a narrower portion of the slot 28 is operative to engage a relatively thicker back portion 32 of the wedge, in alternative embodiments of the present invention, the slot and wedge may have other shapes and dimensions. For example, alternative embodiments may have a slot that is relatively uniform in width. However, to achieve the desired friction and compression forces between the wedge and clamp side walls when the wedge is in the forward position, the back portions of the wedge may have a width that is greater than both the width of front portions of the wedge and the width of back portions of the slot.

Thus the clamping apparatus of the present invention achieves the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the structures shown herein or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

I claim:

1. A clamping apparatus comprising:

a wedge;

a clamp body wherein the clamp body includes:

a mouth that is operative to receive at least one workpiece, wherein the mouth includes a jaw surface; and a slot operative to receive the wedge, wherein the wedge is operative to slide within the slot between a forward position and a rearward position with respect to the clamp body, wherein when the wedge is moved toward the forward position, the wedge is operative to urge the work piece adjacent the jaw surface and is operative to become lodged within the slot, wherein the slot includes an upper portion and a lower portion, wherein the upper portion of the slot is narrower than the lower portion of the slot, wherein when the wedge is moved toward the forward position, portions of the wedge slide adjacent the upper portion of the slot, whereby the portions of the wedge become lodged within the upper portion of the slot.

2. The clamping apparatus according to claim 1, wherein the slot includes a lower surface, wherein the wedge includes a bottom edge that is operative to slide adjacent the lower surface of the slot, wherein the jaw surface of the clamp body is orientated at a first angle with respect to the lower surface of the slot.

3. The clamping apparatus according to claim 2, wherein the first angle is about fifteen decrees.

4. The clamping apparatus according to claim 2, wherein the wedge includes a front upper surface, wherein the front upper surface of the wedge is orientated at a second angle with respect to the bottom edge of the wedge.

5. The clamping apparatus according to claim 4, wherein the first angle corresponds to the second angle.

6. The clamping apparatus according to claim 2, wherein the bottom edge of the wedge is rounded, wherein the lower surface of the slot includes a curvature that corresponds to the bottom edge of the wedge.

7. The clamping apparatus according to claim 2, wherein the wedge includes a back portion and a front portion, wherein the back portion is taller than the front portion with respect to the bottom edge, wherein when the wedge moves toward the forward position, the back portion slides adjacent an upper portion of the slot, whereby the back portion becomes lodged within the upper portion of the slot.

8. The clamping apparatus according to claim 7, wherein a width of the back portion of the wedge is greater than a width of the upper portion of the slot.

9. The clamping apparatus according to claim 7, wherein portions of the back portion of the wedge are operative to receive a first hammer blow, whereby the wedge may be driven toward the forward position; and wherein portions of the front portion of the wedge are operative to receive a second hammer blow, whereby the wedge may be driven toward the rearward position.

10. The clamping apparatus according to claim 2, wherein the width of a portion of the wedge is greater than a width of a portion of the slot.

11. The clamping apparatus according to claim 2, wherein the clamp body includes two opposed side walls which bound portions of the slot.

12. The clamping apparatus according to claim 11, wherein the slot is operative to direct the wedge to slide within the mouth.

13. The clamping apparatus according to claim 11, wherein the side walls converge at an upper portion of the slot.

14. A clamping comprising:

a wedge, wherein the wedge includes a front portion, a back portion, wherein the front portion includes a front upper surface; and a clamp body, wherein the clamp body includes a jaw surface that is operative to receive a workpiece adjacent thereto, wherein the clamp body includes two opposed sides that are operative to receive the wedge in sliding engagement therebetween, wherein the two sides include a back portion, wherein a width of the back portion of the wedge is greater than a distance between the back portions of the two sides, wherein when the wedge is moved from a first position to a second position with respect to the clamp body, the back portion of the wedge slides adjacent the back portions of the two sides, and wherein the front upper surface of the wedge urges a workpiece adjacent the jaw surface of the clamp body, wherein the wedge includes a bottom edge, wherein the front portion of the wedge is shorter in height then the back portion of the wedge with respect to the bottom edge, wherein the two sides include an upper portion and a lower portion, wherein a distance between the lower portions of the two sides is greater than a distance between the upper portions of the two sides, wherein when the wedge is moved from the first position to the second position with respect to the clamp body, the back portion of the wedge slides adjacent the upper portions of the two sides.

15. The clamping apparatus according to claim 14, wherein the front upper surface of the wedge and the jaw surface of the clamp body include teeth.

16. The clamping apparatus according to claim 14, wherein the clamp body includes a lower slot wall that connects the two opposed sides, wherein a distance between a front portion of the jaw surface and the lower slot wall is less than the distance between a rear portion of the jaw surface and the lower slot wall.

17. The clamping apparatus according to claim 16, wherein a line that intersects with the front portion of the jaw surface and the rear portion of the jaw surface is orientated at an angle that ranges between five and 45 degrees with respect to the lower slot wall of the clamp body.

18. The clamping apparatus according to claim 14, wherein the two sides include a front upper portion and a back upper portion, wherein a width of a space between the front upper portions of the two sides is less than a width of a space between the back upper portions of the two sides.

19. A clamping apparatus comprising:

a clamp body, wherein the clamp body includes a slot therethrough, wherein the clamp body further includes a mouth that is operative to receive at least one workpiece therein, wherein the mouth includes at least one jaw surface; and a wedge, wherein the wedge includes a front upper surface, wherein the wedge is operative to slide within the slot toward the jaw surface to engage a workpiece in a clamped position between the front upper surface and the jaw surface, wherein the wedge is operative to become lodged within the slot and maintain the workpiece in the clamped position.

20. The clamping apparatus according to claim 19, wherein the wedge includes a back upper portion and the slot includes a back upper portion, wherein the width of the back upper portion of the slot is less then the width of the back upper portion of the wedge, wherein when the wedge slides forward with respect to the clamp body into the clamped position, the back upper portion of the wedge slides adjacent the back upper portion of the slot.

21. The clamping apparatus according to claim 20, wherein the wedge includes a bottom edge, wherein the front upper portion of the wedge is shorter in height than the back upper portion of the wedge with respect to the bottom edge of the wedge.

22. The clamping apparatus according to claim 21, wherein the slot includes a back lower portion, wherein the width of the back lower portion of the slot is greater than the width of the back upper portion of the slot.

23. The clamping apparatus according to claim 19, wherein the clamp body includes two opposed side walls with the slot therebetween and a lower slot wall in operative connection between the two opposed side walls, wherein the wedge includes a bottom edge that is operative to slide adjacent the lower slot wall.

* * * * *

UNITED STATES PATENT AND TRADEMARK OFFICE

CERTIFICATE OF CORRECTION

PATENT NO. : 6,234,465 B1
DATED : May 22, 2001
INVENTOR(S) : Elias A. Sutton, Jr.

It is certified that error appears in the above-identified patent and that said Letters Patent is hereby corrected as shown below:

Title page,
Item [74], replace "Parmele" with -- Parmelee --.

Column 6,
Line 53, replace "a clamping comprising" with -- a clamping apparatus comprising --.

Column 46,
Line 13, replace "decrees" with -- degrees --.

Signed and Sealed this

Twenty-ninth Day of January, 2002

*Attest:*

*Attesting Officer*

JAMES E. ROGAN
*Director of the United States Patent and Trademark Office*